United States Patent [19]

Jouet

[11] 4,203,205

[45] May 20, 1980

[54] METHOD AND APPARATUS FOR THE MANUFACTURE OF A HEAT EXCHANGER

[75] Inventor: Etienne Jouet, Lamorlaye, France

[73] Assignee: Spirec L'Echangeur Spirale Ever Clean, Paris, France

[21] Appl. No.: 864,796

[22] Filed: Dec. 27, 1977

[30] Foreign Application Priority Data

Dec. 27, 1976 [FR] France ..... 76 39149

[51] Int. Cl.[2] ..... B23P 15/26

[52] U.S. Cl. ..... 29/727; 29/33 G

[58] Field of Search ..... 29/726, 33 G, 727, 157.3 R; 242/67.3 R, 67.3 F, 67.4

[56] References Cited

U.S. PATENT DOCUMENTS

| | | | |
|---|---|---|---|
| 647,900 | 4/1900 | McCurdy | 242/67.3 R |
| 1,937,077 | 11/1933 | West | 242/67.4 |
| 2,054,459 | 9/1936 | Burt | 242/67.4 X |
| 2,097,592 | 11/1937 | Gibbs | 242/67.4 X |
| 2,236,976 | 4/1941 | Rosenblad | 29/157.3 R X |
| 2,533,717 | 12/1950 | Coursey | 242/67.3 R |
| 2,533,718 | 12/1950 | Coursey et al. | 242/67.3 R |
| 3,049,312 | 8/1962 | Simjian | 242/67.3 R X |
| 3,391,041 | 7/1968 | Moore | 29/157.3 R |
| 3,789,786 | 2/1974 | Wiedenmann et al. | 29/727 |

*Primary Examiner*—Francis S. Husar
*Assistant Examiner*—V. K. Rising
*Attorney, Agent, or Firm*—Oblon, Fisher, Spivak, McClelland & Maier

[57] ABSTRACT

A method for the manufacture of a heat exchanger comprising an internal arrangement of general cylindrical shape constituted by winding in a spiral two parallel and adjacent portions of a first band, such as a metal sheet and a second band wound on this arrangement in order to form an outer casing constituting a collar or shell.

8 Claims, 20 Drawing Figures

15
F3
6
F3
17
5
7
13
16
F3
1
12a
12b
10
14
12
F2
11
9
2
F1
3
4
8
x
18

12
13
3
4
14
9
11
10
8
x
12b
F4
1a
2a
1
2

12
4
1a
19
3
2a
x
11
10
8
1
2
9
F5

METHOD AND APPARATUS FOR THE MANUFACTURE OF A HEAT EXCHANGER

The present invention relates to a method and apparatus for the manufacture of a heat exchanger of the type comprising an internal arrangement of general cylindrical shape, constituted by winding in a spiral two parallel and adjacent portions of a first band, such as a metal sheet and a second band wound on this arrangement in order to form an outer casing constituting a collar or shell.

Exchangers of this type are already known, which are made from one or more metal sheets wound in a spiral around a mandrel, these sheets defining concentric chambers receiving the streams of fluid which exchange their heat through the walls of these chambers. Heat exchangers made from sheet metal wound in a spiral have advantages as regards the considerable exchange surface area which they provide and their simplicity of manufacture, since it is sufficient to assemble the metal sheets and wind the latter in order to produce the basic framework of the exchanger.

According to a known method for the manufacture of heat exchangers of this type, a group of one or more metal sheets wound as a spiral is firstly provided on a mandrel, then, once this group has been formed, an outer casing is placed around the latter, which is retained by binding and finally the arrangement formed in this way is placed in a tube forming a shell and the space comprised between the inner arrangement, formed in the preceding manner and the outer tube is filled with cement. All these manufacturing stages are therefore long and troublesome.

Furthermore, in order to form the group wound in a spiral, the method employed hitherto uses a metal sheet whose longitudinal edge is previously subjected to a shaping operation which consists of folding the sheet at right-angles to itself, a first time, then a second time perpendicularly towards the outside in order to obtain a marginal flange parallel to the sheet, extending towards the outside and intended to be placed against an unfolded marginal part of an adjacent sheet. This prior operation is carried out on a press, which limits the length of the sheet which can be used for the manufacture of the exchanger, this length effectively depending on the width of the press.

The present invention essentially intends to remedy these drawbacks by providing a method and apparatus which make it possible, by very simple means, to obtain a group of sheets provided with an outer shell, in a single station, without any limitation of length as regards the sheet used.

To this end, this method for the manufacture of a heat exchanger comprising an internal arrangement of general cylindrical shape constituted by winding in a spiral two parallel and adjacent portions of a first band, such as a metal sheet and a second band wound on this arrangement to form an outer casing constituting a collar or shell is characterised in that the first portion of the first band is fixed transversely to the transverse edge of the second band and this is at a certain distance from the end of the first band, such that the end part of the first portion of the first band remains free over a certain distance as far as the area in which it joins the second band, then the two portions of the first band are wound simultaneously about themselves in a first direction, beginning at the height of a transverse line adjacent the centre of this first band and whilst exerting controlled longitudinal tension on the second band and consequently on the first portion to which it is fixed, the winding operation is then stopped when the free end of the first portion has been wound and is aligned with the end of the second portion of the first band, rotation of the arrangement thus wound in a spiral is then brought about in a second direction which is the reverse of the first winding direction, whilst exerting controlled tension on the second band, then this rotation is stopped and the two ends of the first and second portions of the first band are welded in a liquid-tight manner, then the arrangement wound in a spiral is once more rotated in the first direction in order to cause the winding of the second band on this arrangement, whilst exerting controlled tension on this second band, until complete winding over at least one revolution and finally the free end of the second band is secured to itself.

The invention also relates to an apparatus for carrying out the preceding method, comprising a frame on which a mechanism for winding the band in a spiral is mounted, this mechanism comprising a motor rotating means co-operating with the band for winding the latter in a spiral, characterised in that it comprises a drum forming an unwinding device on an axis parallel to that of the mechanism for winding in a spiral at least one element which can be wound, such as a band, cable, fixed at one of its ends to this drum and able to be secured, at its other end, to the end part of the second band intended to form the outer casing of the exchanger, a second motor for rotating the drum and an adjustable braking device acting on the drum.

The method and apparatus according to the invention make it possible to reduce the manufacturing time for exchangers by approximately 50%. Furthermore, they make it possible to obtain exchangers of better quality owing to the fact that the metal sheets wound in a spiral are subject to controlled tension permanently throughout the stages of the manufacturing method and that the arrangement constituted by the inner group wound in a spiral and the outer casing is made at one and the same point.

The invention will be better understood from the detailed description given hereafter with reference to the accompanying drawings. Naturally, the description and drawings are given solely as non-limiting examples.

The method according to the invention intends to wind a band which is to form two parallel spirals. For this, one begins the winding through a transverse line of the band located in the vicinity of its centre, taking into account the fact that the two portions, measured from this line, do not have the same length for geometric reasons.

Figure 1:
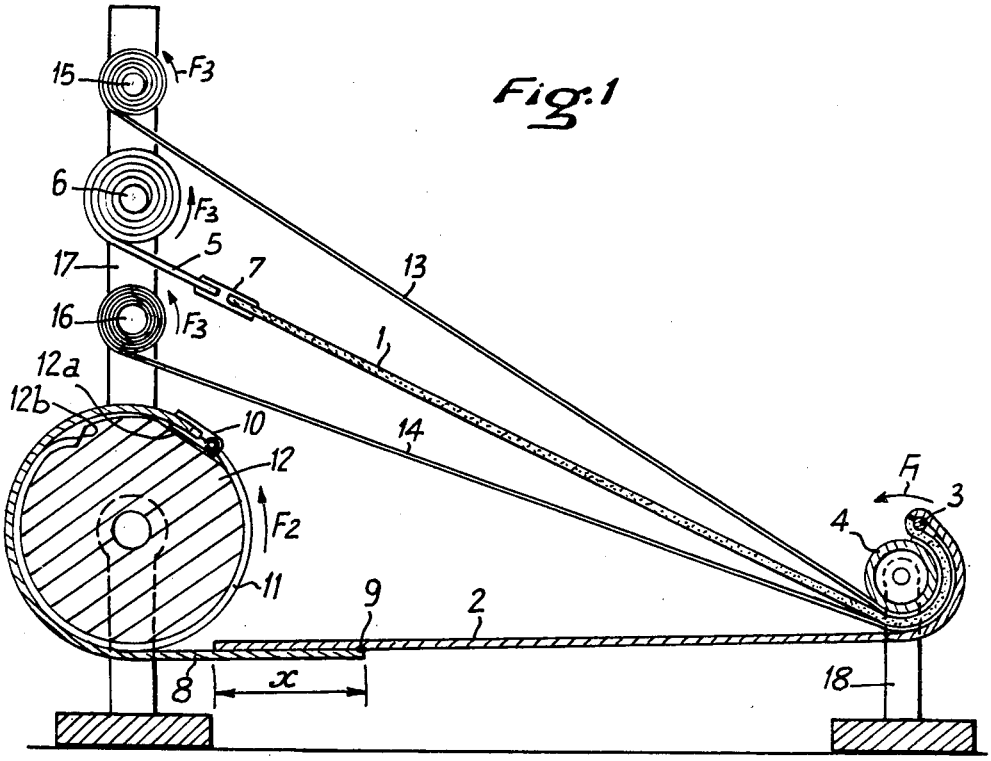
FIGS. 1 to 3 are diagrammatic side views of an apparatus carrying out the method according to the invention, in three different stages.
Figure 2:
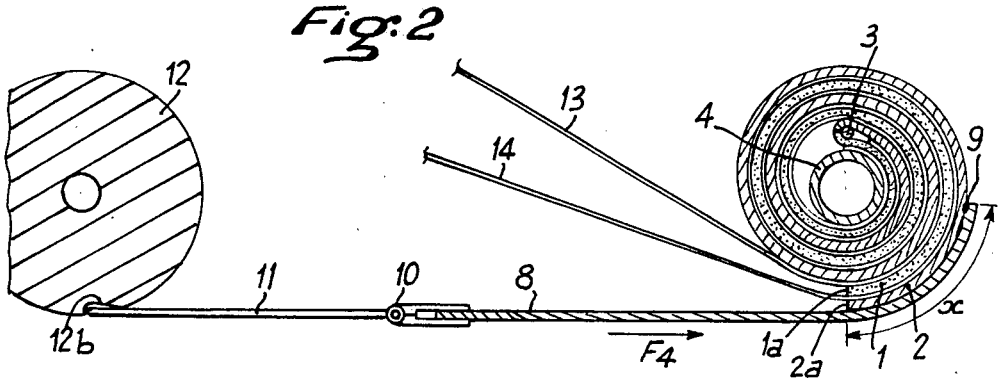
Figure 3:
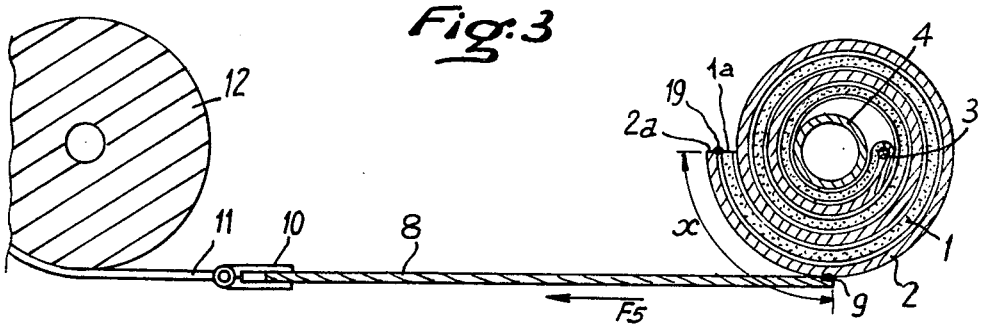
Figure 4:
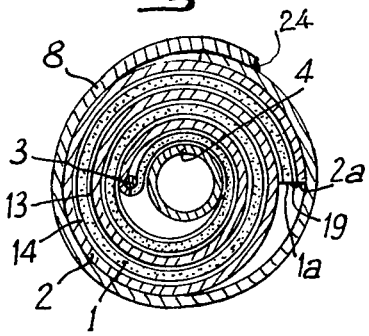
FIG. 4 is a diagrammatic side view of the completely wound and encased arrangement obtained with the apparatus of FIGS. 1 to 3.

FIGS. 1 to 3 show that the two portions 1 and 2 are two parts of the same continuous band folded over on itself. However, in order to simplify understanding the invention, these two portions can be distinguished by the fact that for their sectional illustration, dots have been used for the portion 1 and dashes for the portion 2. This band is in fact a metal sheet intended to constitute the separating walls of a heat exchanger between two fluids.

If the two portions 1 and 2 belong to the same metal sheet, one thus begins by folding the latter on itself along a correctly chosen transverse line. However, this metal sheet or band can be obtained by welding two different metal sheets along two of their appropriately shaped ends.

In both cases, the two portions 1 and 2 are engaged on and around a transverse bar 3 in order that the latter is placed against the joining line (folding or welding) of the two portions 1 and 2, inside the latter. The connection of the portions should thus take place along a profile corresponding to that of the bar 3. The latter is parallel to a transverse cylindrical core 4 and at a distance substantially equal to the thickness of the metal sheet constituting the portions 1 and 2. In practice, this bar 3 may be replaced by two lateral fingers of short length, extending transversely.

The free end of the portion 1 is retained and guided by a member 5 which can be wound, engaged on a transverse drum 6 mounted to rotate on a frame 17, this windable member 5 being terminated by grippers 7. This windable member can be constituted by a band, cables etc.

The free end of the portion 2 is fixed along a transverse line 9, by welding, sticking, riveting or any other means, to a second band 8 which is intended to constitute an outer casing or collar around the metal sheets wound in a spiral.

It will be noted that the transverse line 9 along which the portion 2 is connected to one end of the collar 8 is located at a distance x from the free end of the portion 2 for reasons which will be explained hereafter. The collar 8 is engaged, by its other end, in grippers 10 fixed to the end of a windable member 11 (for example a band) which extends the metal sheet 8 in some way. This windable member 11 is fixed transversely along one generatrix, to a drum 12 mounted to rotate on the frame 17 about a transverse axis. This drum 12 comprises transverse recesses (i.e. parallel to one generatrix) respectively 12*a* and 12*b*, in which the grippers 10 and members for securing the windable member 11 are housed, in order that they do not form an excess thickness when this arrangement is wound on the drum 12 (FIG. 1).

The wound metal sheets have to be separated by gaps in order that the fluids may flow therebetween. For this it is possible to use either reliefs which are formed by permanent deformations provided on the portions 1 and 2, or attached spacer members. In the first case, these deformations must be produced before winding. It is possible to use stamped metal sheets for example, comprising bosses distributed over the surface of the sheets or even pre-formed sheets, for example corrugated sheets or even sheets having projecting tongues obtained from slits.

In the non-limiting embodiment illustrated in the drawing, attached spacer members are used, which are constituted by threads 13 and 14 arranged in parallel, in two layers. It is possible either to secure these threads before winding or preferably to position them as winding takes place. The two layers of threads 13 and 14 are stored on drums 15 and 16 having transverse axes and supported by the frame 17. At the beginning of the method, their free ends are engaged respectively between the core 4 and the portion 1 on the one hand and between the portions 1 and 2 on the other hand. The ends of the threads 13 and 14 are fixed by any known means (wedging, sticking etc.) such that they extend as close as possible to the connecting line between the two portions 1 and 2.

Figure 17:
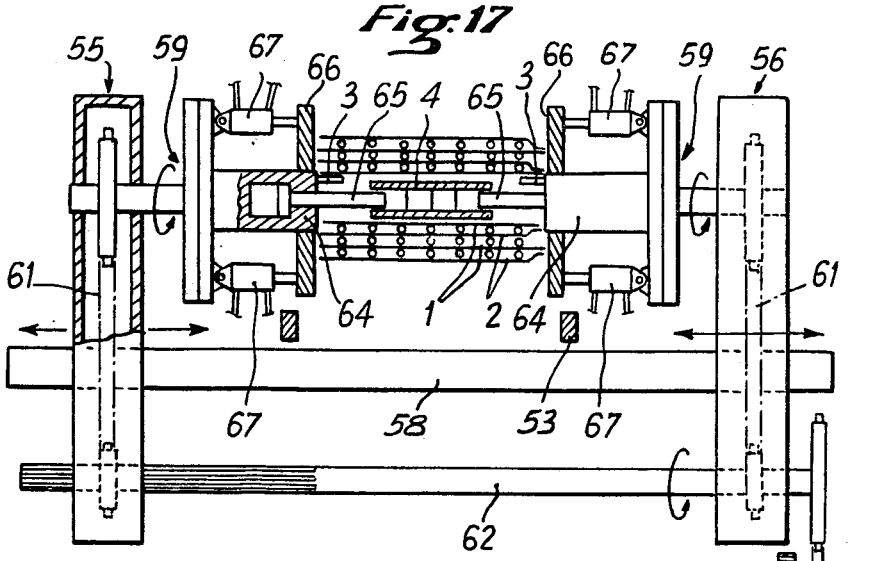
FIG. 17 is a diagrammatic elevational view of the mechanism for winding the sheets in a spiral.

The core 4 is mounted, possibly so that it can be detached, on coaxial supports (c.f. FIG. 17) maintained at the correct height by a frame 18.

Figure 16:
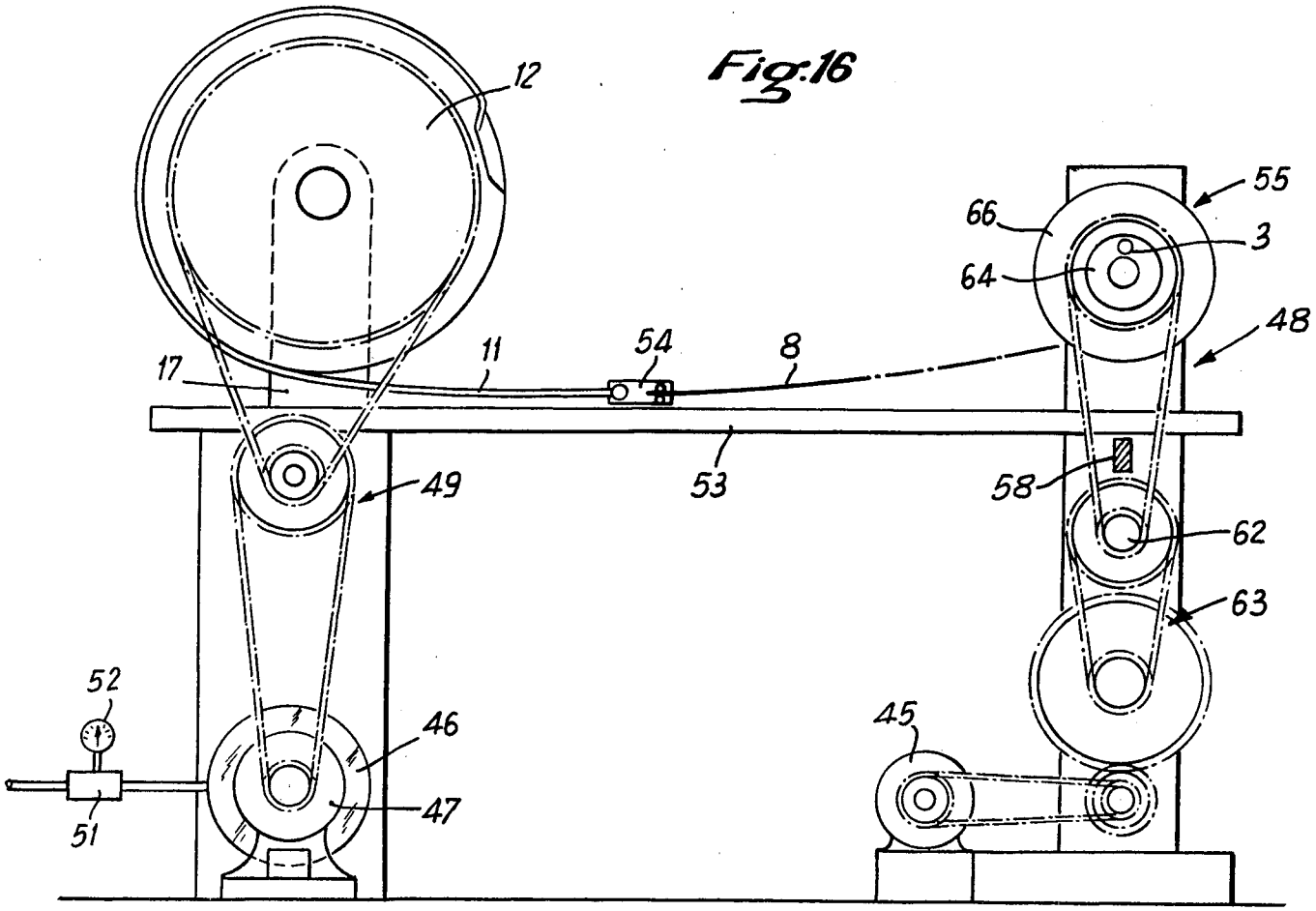
FIG. 16 is a diagrammatic side view of an apparatus carrying out the method according to the invention.

The bar 3 and possibly the coaxial supports of the core are connected to a rotary driving mechanism whose axis is that of the core 4 which will be described hereafter with reference to FIGS. 16 and 17. This means that the bar 3 travels parallel to itself over a virtual cylinder whose axis is that of the core 4 and whose radius is the distance which separates this axis from that of the bar.

According to the method of the invention, the two portions 1 and 2 and the threads 13 and 14 are wound simultaneously in a spiral whilst exerting controlled tension on the portion 2. This tension is obtained by means of the band 8 and the windable member 11, by means of a drive motor 45 (FIGS. 16 and 17) to which the bar 3 and the core 4 are connected, whereas the drum 12 is provided with an adjustable brake 46. This tension should be controlled in order to correspond to the desired tightness of the arrangement and should naturally be less than a predetermined value which would be incompatible with the mechanical strength of the members, thus causing: rupture of the metal sheets, breakage of the weld 9, sliding of the parts 10 etc. For this, a torque limiting device (not shown) is provided for example in the device for driving the drum 12, which also comprises a drive motor 47 (FIG. 16).

The operation of the apparatus described, which conforms with the method according to the invention is as follows: at the beginning, the portions 1 and 2 as well as the threads 13 and 14 are connected to the bar 3 when the latter is located at the lowest point of its travel (below the core 4). The motor 45 is then started in order that the bar 3 (arrow F1) and the drum 12 (arrow F2) both rotate in counter-clockwise direction, the brake 46 ensuring the required tension of the portion 2 and band 8. The drums 6, 15 and 16 also rotate in counter-clockwise direction (arrow F3), owing to the traction exerted on the portion 1 and on the threads 13 and 14.

When the bar 3 has completed a certain number of revolutions, it has caused the portions 1 and 2 to be wound in the form of a spiral on the core 4 and the winding operation is thus stopped for a first time in order to cut the threads 13 and 14 at a sufficient distance from the end of the portions 1 and 2 and a second time when the free ends 1*a* and 2*a* of the portions 1 and 2 have reached (according to the arrow F4 of FIG. 2) at least the position shown in this Figure, i.e. when the entire length of the portions 1 and 2 have been wound on the core and consequently is in the shape of a spiral.

At this time, the motor 47 for driving the drum 12 is started, in order to rotate the latter in clockwise direction and the supply of power to the motor 45 is regulated, such that it acts as a brake in order to maintain the desired tension of the metal sheet 8, which moves back in the direction of arrow F5, whereas the free parts of the portions 1 and 2, between their ends 1*a*, 2*a* and the welding region 9 (length x) remain pressed against the wound arrangement.

During partial unwinding, when the position shown in FIG. 3 is reached, the motors 45 and 47 are stopped and it is possible to proceed with the sealed connection of the ends 1*a* and 2*a* of the portions 1 and 2, for example by means of a weld 19.

Once this welding operation is terminated, the motors 45, 47 are re-started in the winding direction (arrows F1–F2), until the collar 8 has been wound.

If the collar 8 constitutes a relatively thin casing, it is possible to wind the latter around the arrangement several times, consequently providing an adequate length and its free end is secured to itself, by welding, as will be described hereafter. The arrangement may thus be completed, as known per se, by a relatively thick shell which surrounds this arrangement leaving an annular space which is filled with cement.

However, this shell may also be obtained directly by winding: this assumes that the collar 8 constitutes the shell itself and that it consequently has a thickness greater than that of the portions 1 and 2.

In this case, it may prove useful if the shell is higher than the arrangement wound in the form of a spiral.

Figure 6:
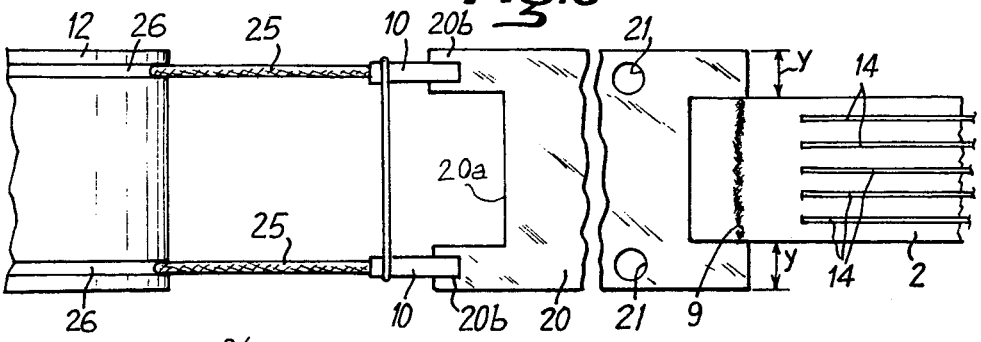
FIG. 6 is a diagrammatic plan view of a variation.

FIG. 6 shows that the second band 20 is a shell of relatively thick sheet metal and the width of which is greater than that of the portion 2. The latter and the shell 20 are coaxial such that their sides are staggered by a distance y which corresponds to half the difference in height between the arrangement wound in the form of a spiral and the outer shell, as is shown in FIG. 7.

Figure 7:
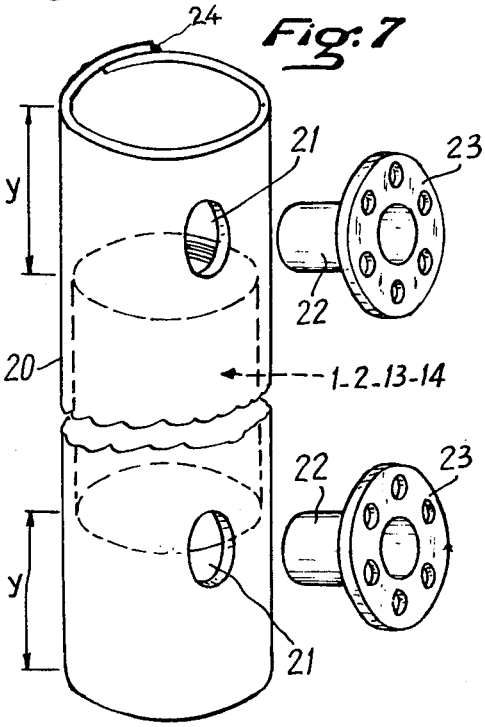
FIG. 7 is a diagrammatic view in perspective showing a detail of an arrangement obtained with the invention.

Since the shell 20 may have radial passages for the circulation of fluids, it may be advantageous according to the invention to obtain these passages by providing holes 21 in this shell before winding (FIGS. 6 and 7). When the arrangement is completed, sections of tube 22 provided with flanges 23 for connection to pipes carrying the desired fluids are welded in facing relationship to the passages 21.

Attachment of the second band (collar 8 or shell 20) causes problems, since the transverse edge of this band is connected to the extension member on which the tension of the arrangement is exerted.

This problem can be resolved in various ways according to the invention.

Figure 5:
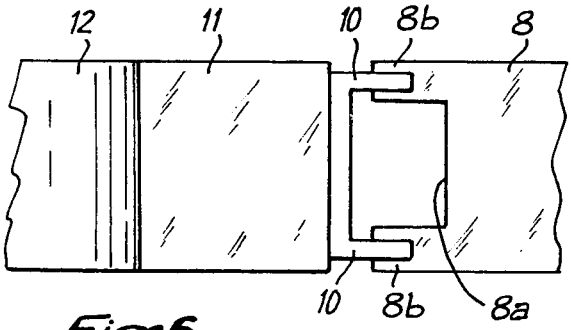
FIG. 5 is a partial diagrammatic plan view corresponding to FIG. 3.

When using grippers 10, a first solution consists of providing in the transverse edge of the band constituting the collar 8 or the shell 20, a cut-out 8*a* (FIG. 5) or 20*a* (FIG. 6) such that two lugs, respectively 8*b* and 20*b* exist. The grippers 10 are attached to these lugs of relatively slight width. During winding, the second band (8 or 20) is completely wound, but not the lugs, since care is taken to stop the winding in time.

At this time, it is possible to make several spot welds along the edge of the cut-out which constitutes a temporary attachment. Naturally, this attachment may be obtained by other means: sealing, sticking etc.

When this attachment has been made, it is possible to undo the grippers 10. The lugs 8*b* or 20*b* are easier to fold back than the entire band would have been. But it is also possible to cut the latter, in order to eliminate them.

In both cases, the attachment is terminated for example by a continuous weld 24, not only of the central part of the band, but also of the lugs or of the cut part.

Another solution consists of providing the member 11 in a material which is able to serve for securing it to the second band. In this case, instead of using grippers 10, the second band and member 11 are connected. After having achieved complete winding of the second band, a temporary attachment is made, then a fraction of the length of the member 11 is cut and after having folded back this fraction, it is fixed permanently.

It will be understood that according to this variation of the method, a fraction of the length of the member 11 is used for each complete arrangement. After a certain number of arrangements have been manufactured, it is necessary to renew the member 11.

FIG. 6 shows that the member which extends the second band 20 may be constituted not by a band 11, as in the case of FIGS. 1 to 5, but by two cables 25. In order that the latter do not create any excess thickness when they are wound on the drum 12, two grooves 26 of sufficient depth are provided on the latter in order that the cables 25 are housed perfectly therein.

The means by which the portions 1 and 2 are wound may have several variations.

Figure 8:
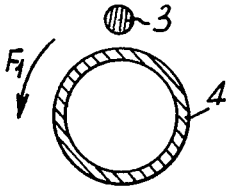
FIGS. 8 and 9 are diagrammatic views of two variations of a drive mechanism according to the apparatus of the invention.

FIG. 8 shows separately the bar 3 and the core 4 of FIGS. 1 to 4. It should be noted that the core 4 may either remain integral with the wound arrangement in order to form a constituent part thereof, or form part of the apparatus, in which case, after winding, the arrangement is removed by sliding it laterally both on the bar 3 and on the core 4.

Figure 9:
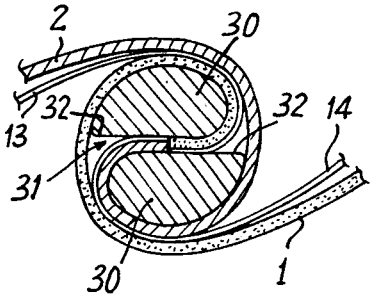

According to another variation, a split core is used. FIG. 9 shows a core 30 of this type provided with a longitudinal slot 31 whose width is substantially equal to the thickness of the first band which is engaged in this slot 31. The two parts of the core 30 each have a type of ramp 32 which extends the periphery of the core radially beyond the opposite profile and this is over a distance equal to the depth of the band to be wound, in order that after one revolution, the latter forms a regular spiral without any sudden variation of its radius of curvature.

This shape will be easily understood by examining FIG. 9.

According to another variation, two substantially cylindrical independent cores are used, which as already described, may be either part of the apparatus or a constituent part of the complete arrangement.

Figure 10:
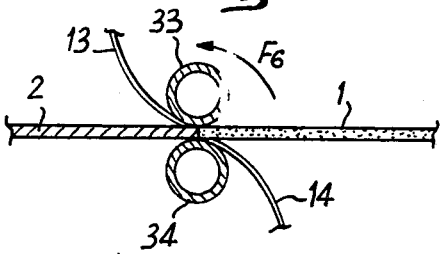
FIGS. 10, 11 and 12 are diagrammatic views, in three different stages, of another drive mechanism according to the apparatus of the invention.
Figure 11:
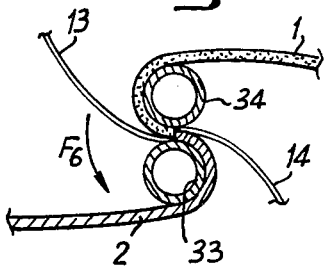
Figure 12:
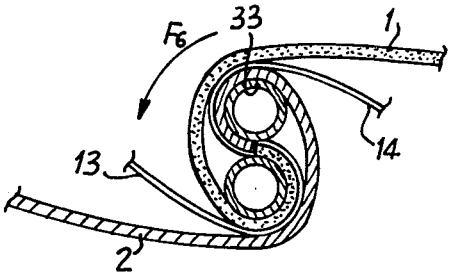

FIGS. 10 to 12 illustrate such a variation.

The two parallel cores 33 and 34 are separated by a distance substantially equal to the thickness of the band to be wound, in order that the latter can be easily introduced between the cores 33 and 34. The portions 1 and 2 are located on either side of these cores. At the beginning of the process, (FIG. 10), the ends of the threads 13 and 14 are engaged between the portions 1, 2 and the cores 33, 34, then the two cores are rotated in the direction of arrow F6 about a common virtual axis parallel to the axes of the cores, which passes between the latter at an equal distance from the latter. After half a revolution, the arrangement is located in the position shown in FIG. 11 and after a complete revolution, in the position shown in FIG. 12.

According to a more elaborate embodiment, wedges are provided between the first turns of the portions 1 and 2, on the one hand and the core or cores on the other hand.

Figure 13:
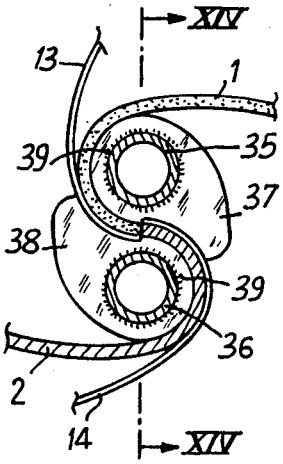
FIG. 13 is a diagrammatic view of the same mechanism as that of FIGS. 10 and 12, but constructed according to a variation.
Figure 14:
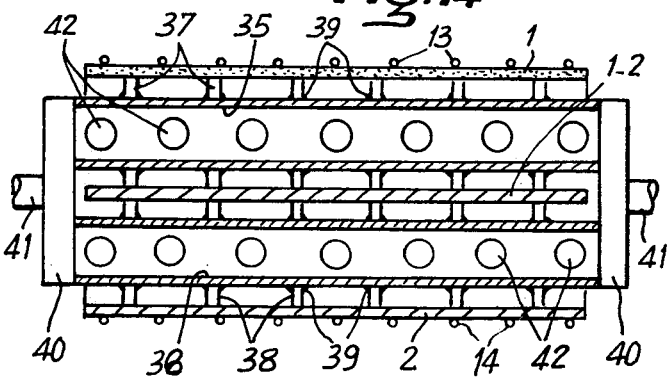
FIG. 14 is a diagrammatic sectional view taken on line XIV—XIV of FIG. 13.

Thus, FIGS. 13 and 14 show an arrangement comprising two cores 35 and 36 which are intended to constitute central tubular chambers and to which transverse wedges 37 and 38 have been fixed by means of welds 39.

The wedges 37 and 38 are in the shape of "drops of oil". This shape as well as the arrangement of the wedges with respect to each other can be easily understood by examining FIG. 13.

In view of the radial depth of the wedges, the spacing of the cores 35 and 36 is equal to twice this depth plus the thickness of the band to be wound, in order that the latter can be easily engaged between the wedges. As in the case of FIGS. 10 to 12, the arrangement is rotated along a common axis parallel to the axes of the cores 35, 36, in the same plane as the latter and at the centre thereof. FIG. 14 shows that this can be obtained by means of a device whose rotary drive mechanism comprises two lateral/supports or cheeks 40, provided with means known per se for their connection to the cores 35 and 36 and integral with crank pins 41, at least one of which is kinematically connected to the motor.

It can be seen that the wedges 37 and 38 form a partition at right-angles to the axis of the arrangement. However, in order to facilitate the correct circulation of the fluids, holes or passages 42 are provided in the cores 35 and 36 (which constitute tubular chambers), which holes connect the chambers to the corresponding space existing between the outer wall of the cores and the inner side of the first turn of the portions 1 and 2.

It is also possible to provide radial wedges with the drive mechanism comprising a bar, as illustrated in FIGS. 1, 2, 3 and 8.

Figure 15:
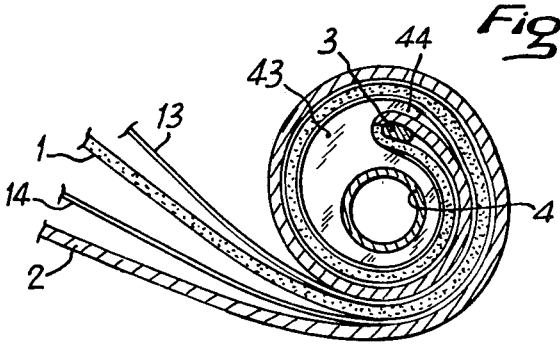
FIG. 15 is a diagrammatic view of a variation of the drive mechanism of FIG. 8.

This is shown in FIG. 15, where the core 4 (constituting a central tubular chamber), in the manner of FIG. 14, receives radial wedges 43 whose shape is such that the first turns are guided harmoniously, without a sudden change in the radius of curvature, even opposite the bar 3, owing to a type of nose 44 in which the wedge terminates. It will be noted that the first turn of the portion 1 no longer presses directly against the core 4, but against the wedges 43.

The particular shape of the wedges 43 will be easily understood on examining FIG. 15.

It is also possible to provide wedges of this type in the shape of "drops of oil" whose surface comprised between the central core and the periphery is provided with openings to allow the passage of fluid. In this case, the cores 35 and 36 may have a reduced diameter and should not be provided with holes 42.

A non-limiting embodiment of the apparatus using the method according to the invention will now be described with particular reference to FIGS. 16 and 17. This apparatus firstly comprises the drum 12 forming an unwinding device and secondly a stand for winding in a spiral designated generally by the reference numeral 48. The drum 12 which is mounted to rotate about a horizontal and transverse shaft on the frame 17 is connected by means of a transmission device 49 comprising pinions and chains, to the drive motor 47. Associated with this motor is a torque-limiting device which ensures automatic disenegagement if the tension of the wound metal sheet exceeds a predetermined value.

Furthermore, a hydraulic disc brake 46 is also connected to the device 49 for driving the unwinding device 12 in order to brake this unwinding device to a greater or lesser extent during winding of the metal sheet.

The hydraulic brake 46 is connected to a master cylinder 51 regulating the pressure applied to the brake 46, this pressure being controlled by means of a pressure gauge 52. When winding the sheet metal in a spiral, this device makes it possible to regulate very accurately the tension on the latter, whatever the speed of travel which can also be modified.

The stand 48 for winding in a spiral is located at a certain distance in front of the unwinding device 12. Extending between the latter are longitudinal members 53 on which a carriage 54 for attaching the metal sheet can be moved horizontally, which carriage is connected to the unwinding drum 12 by cables 11.

The winding stand 48 comprises two loose driving head-stocks 55, 56 located opposite each other and able to be moved transversely on a cross member 58 of the frame, for the purpose of adaptation to the width of the metal sheet used. Each of the winding head-stocks 55, 56 comprises a winding mandrel 59. The two mandrels 59 have coaxial transverse axes and on their opposing front faces, they support coaxial drive pins 3. Each mandrel 59 is connected by means of a transmission mechanism 61 comprising chains and pinions to a splined transverse drive shaft 62 itself connected by means of a connecting mechanism 63 to the output shaft of the motor 45. This motor 45 may be provided with a torque-limiting device and in fact it may be constituted by a speed-reducer also comprising a direct current speed-varying device. It is thus possible to vary the speed of rotation of the drive mandrels 59 and consequently the speed of travel of the metal sheet wound in a spiral, as desired.

Winding tools 64 which differ according to the type of winding desired are in fact fixed to the drive mandrels 59. It is these tools 64 which in the example illustrated in FIG. 17 support the coaxial drive pins 3. These driving tools 64 make it possible to release the arrangement wound in a spiral rapidly.

The winding tools 64 comprise retractable axial spindles 65 which are engaged in the two end parts of the central core 4 on which the winding is formed and which can be retracted inside the tools 64 in order to release the arrangement wound in a spiral. This retraction may be controlled by hydraulic means, for example by associating the spindles 65 with piston heads sliding inside the tools 64.

Figure 20:
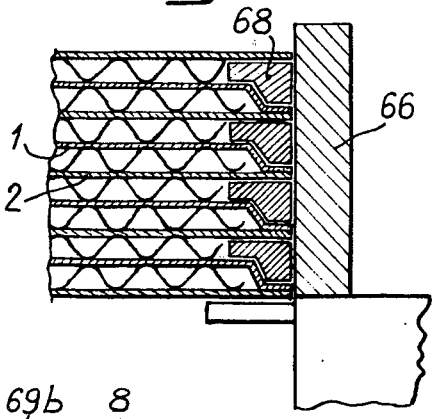
FIG. 20 is a partial longitudinal sectional view of two portions of a metal sheet wound in a spiral, with the interposition of a gasket between their edges to ensure shaping of one of the latter during winding.

These tools 64 also comprise transverse cheeks 66 which may be moved axially on the bodies of the tools 64, with a view to keeping the edges of the metal sheets in the same transverse plane during winding. Adjustment of the position of the cheeks 66 can be ensured either by screwing the latter onto the screw-threaded bodies of the tools 64 or even by means of a hydraulic ram 67, as illustrated in FIG. 17. These cheeks 66 make it possible to ensure perfect parallelism of the metal sheets during and at the end of winding and also the retention of a member 68 for shaping the edges of the sheets, as shown in FIG. 20. This shaping member 68 is constituted by an elongated member whose cross section is in the shape of an angle iron, having two sides of different thickness, which is slid, at the time of winding, between the edges of adjacent sheets. Consequently, during this winding and owing to the high tension exerted on the sheet, this shaping member 68 causes bending of the edge of one of the portions 1 of the sheet such that this edge has a perpendicular side in turn extended by a flange extending towards the outside and coming into contact with the other non-deformed portion 2, for the purpose of its subsequent welding to the latter. Once the winding is completed, the shaping member 68 is withdrawn and one proceeds to weld the curved edge of the portion 1 to the uncurved edge of the portion 2.

Figure 18:
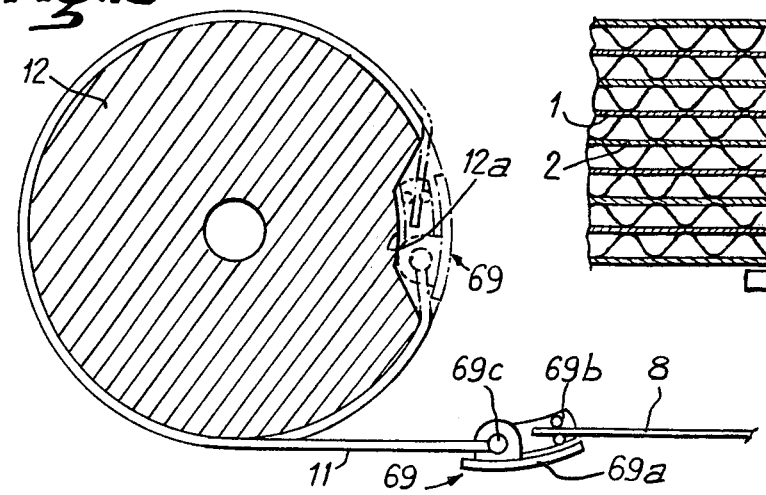
FIG. 18 is a side view of the drum forming an unwinding device.

FIG. 18 shows a particular embodiment of the drum 12 forming the unwinding device. In its peripheral surface, this drum comprises a recessed part **12*a* in which a cover 69 is housed, ensuring the continuity of the peripheral surface of the drum 12 and also forming means for engaging this sheet metal. This cover 69 comprises an outer plate 69*a* ensuring the continuity of the peripheral surface, a device 69*b* ensuring the attachment by knurled wheels of the end part of the second band 8 forming the outer collar and a device 69*c* intended for the attachment of the cables 11 wound on the unwinding device 12. The dot-dash lines in FIG. 18 illustrate the position occupied by the cover for the attachment of the sheet metal when it is housed in the recessed part 12*a* of the drum 12** and the full lines represent its position when removed from this drum, during the latter part of the winding stage.

Figure 19:
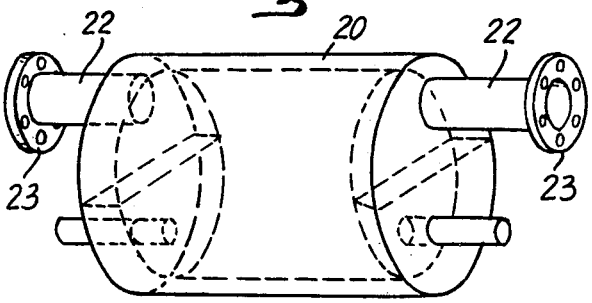
FIG. 19 is a perspective view of a heat exchanger obtained by the method according to the invention.
Figure 19:
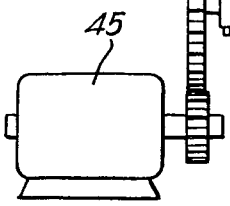

FIG. 19 is a perspective view of a heat-exchanger similar to that of FIG. 7 and which can be obtained by carrying out the method according to the invention. In this case, the pipes for the inlet and outlet of fluid, such as 22, 23 extend longitudinally and not radially as in the case of FIG. 7.

It is apparent from the preceding description that the invention makes it possible to manufacture heat exchangers which are strong and economical, owing to simple, rapid and economical manufacture. Owing to the elimination of previous shaping of the sheets, there is no longer any limitation as regards the length of the sheets wound in a spiral.

The apparatus carrying out the method according to the invention may be easily inserted in an automated arrangement for the manufacture of heat exchangers.

The invention is not limited to the embodiments described and illustrated, but on the contrary includes all variations.

In particular, the grippers may be adjustable, both as regards width and depth, or even length. The two driving cores may be equal or unequal, of identical or non-identical shapes.

Furthermore, it goes without saying that it is possible to wind more than two portions in a spiral, at the same time, for example three or four sheets.

We claim:

1. An apparatus for the manufacture of a heat exchanger which includes at least one first band and a second band fixed to said first band and forming a casing for said heat exchanger, said apparatus comprising a frame upon which is mounted a mechanism including:

a means for winding said bands into a spiral, said means having an axis and being driven by a motor;

an unwinding device in the form of a drum having an axis which is parallel to that of said means for winding;

at least one elongated windable member fixed at one end to said drum and removably fixed at another end to one end of said second band and adapted to connect said drum with said second band;

a second motor for rotating said drum; and an adjustable braking device acting on said drum.

2. Apparatus according to claim 1, in which at least one windable member is connected by its free end to at least one removable connecting member intended to co-operate with the end of the second band and the drum comprises, on its peripheral surface, at least one transverse recess in which one of the windable member and each detachable connecting member is housed in order not to form an excess thickness.

3. Apparatus according to claim 1, in which the mechanism for winding in a spiral comprises, on the one hand, two coaxial supports for receiving a core on which it is intended to form the winding in the form of a spiral and on the other hand, at least one drive member parallel to the axis of the supports and separated radially from the core by a distance substantially equal to the thickness of the band to be wound, the drive member being constituted by a bar which extends over the entire width of the band to be wound or by two coaxial pins of short length located opposite each other.

4. Apparatus according to claim 1, in which the mechanism for winding in a spiral comprises two cylindrical parallel cores separated from each other by a distance substantially equal to the thickness of the band to be wound and connected to a common rotary shaft whose virtual axis passes between the cores.

5. Apparatus according to claim 3, in which the core or cores are removable and form part of the wound arrangement.

6. Apparatus according to claim 4, in which the core or cores are integral with radial wedges.

7. Apparatus according to claim 3, in which the mechanism for winding in a spiral comprises a core, which has a transverse slot whose width is substantially equal to the thickness of the band to be wound.

8. Apparatus according to claim 1, in which the mechanism for winding in a spiral comprises two winding head-stocks able to be adjusted transversely and each comprising a winding mandrel, a winding tool fixed in a removable manner on each winding mandrel and an adjustable cheek on the winding tool for the lateral retention of the sheets and a shaping member interposed between the adjacent edges of the sheets.

* * * * *